United States Patent [19]

Cantieni-Habegger et al.

[11] Patent Number: 4,946,161

[45] Date of Patent: Aug. 7, 1990

[54] TRAINING APPARATUS

[75] Inventors: Benita Cantieni-Habegger; Hanspeter Habegger, both of Zürich, Switzerland

[73] Assignee: Habegger Marketing, Zürich, Switzerland

[21] Appl. No.: 310,131

[22] Filed: Feb. 14, 1989

[30] Foreign Application Priority Data

Feb. 15, 1988 [CH] Switzerland ..... 538/88

[51] Int. Cl.[5] ..... A63B 21/02

[52] U.S. Cl. ..... 272/137; 272/141; 272/142; 272/143

[58] Field of Search ..... 272/134, 141, 142, 137, 272/143, 67

[56] References Cited

U.S. PATENT DOCUMENTS 3,268,225 8/1966 Kolbel ..... 272/137
4,239,212 12/1980 Hickey ..... 272/141
4,842,273 6/1989 Schmeiss ..... 272/137

FOREIGN PATENT DOCUMENTS 2109484 5/1972 France ..... 272/141
1489824 10/1977 United Kingdom ..... 272/135

*Primary Examiner*—Richard J. Apley
*Assistant Examiner*—D. F. Crosby
*Attorney, Agent, or Firm*—Walter C. Farley

[57] ABSTRACT

The training apparatus is used for the planned strengthening of individual muscle groups. It preferably has two spring bodies, each having a terminal gripping element. The gripping elements of one spring body are terminally arranged on one bar-like spring element and the terminal gripping element of a second spring body on a bar-like spring element can be inserted in the gripping element of the first spring body. Thus, the apparatus can either be tensile stressed and/or compression stressed.

9 Claims, 3 Drawing Sheets

TRAINING APPARATUS

The invention relates to the field of physical culture and deals with a training apparatus for use in connection with particular muscle groups, e.g. the shoulder girdle-arm region or the pelvic region.

BACKGROUND OF THE INVENTION

Generally muscle training apparatuses are used for activating muscles or muscle groups under difficult conditions and outside standard movement sequences. This aims at uniformly stressing motor organs of the body and compensating unevennesses of muscle use, which are custom and hierarchically caused. As muscles have always been related to masculine activities and as muscle training apparatuses are mainly designed for obtaining above average muscle capacities, as is apparent from the known training apparatus, there has been little development in connection with training apparatus for use by females. In the more favourable case the same apparatus as used for males is used in a weaker form for females, without taking any account of special requirements.

This is made apparent by the fact that e.g. muscle training apparatuses which are intended to strengthen the biceps and which are generally constituted by spiral spring apparatuses for pulling apart with both hands or for bending (nowadays also elastic bodies) are offered in a weaker or reduced strength form for females. However, it is well known that overdeveloped biceps are neither desired by women, nor considered attractive by men in women. Therefore such apparatus types are clearly unsuitable for the average woman wishing to keep fit.

It must also be borne in mind that muscle training equipment designed for male requirements require not inconsiderable hand forces or strength levels, in order to activate the desired muscle groups in the remainder of the body. However, such hand strength is not required for female use. Finally, on changing from different strength stages, the apparatus are tailor-made for male requirements and the changeover process often requiring considerable strength has been paid little attention by apparatus inventors. This must also be taken into account in connection with a muscle training apparatus suitable for women.

In addition, a training means designed for strengthening certain muscle groups, must not be used for strengthening other muscle groups not included therein. An all-round apparatus leads to inappropriate training, i.e. preference is given to an easier training sequence considered to be individually more pleasant and only inadequate working takes place with the muscle group which is in fact aimed at. This is e.g. the case with an apparatus based on a stiff spiral spring, which can be bent, pulled and also compressed at random. These less specifically operating equipments may be very popular, but this does not make their operation more specific.

Muscle training apparatus operating with a deformation attainable by strength are subject to many complaints due to injuries. This is not surprising. If for any reason an anchoring system or the hand strength fails and the force stored in the apparatus is suddenly released, this can lead to incalculable injuries and damage. Here again the all-around apparatus with its potential risks is not advantageous. Therefore an apparatus should be designed in such a way that such accidents cannot occur, even if a large amount of force is to be stored therein.

SUMMARY OF THE INVENTION

An object of the present invention is to provide an apparatus meeting female requirements, which operates specifically, is completely safe, in which no special hand strength or force is required and which requires neither force, nor any technical skill on changing to other force or strength levels.

Briefly described, the invention includes a training apparatus for the planned strengthening of individual muscle groups with at least one spring body with at least one gripping element thereon, characterized in that the at least one gripping element of a first spring body are terminally arranged on a spring element and that the terminal gripping elements of a second spring body are so constructed with at least one further spring element that the gripping elements of the first spring body can be inserted in the gripping elements of the second spring body.

BRIEF DESCRIPTION OF THE DRAWINGS

Various embodiments of this muscle training apparatus are described in non-limitative manner hereinafter with reference to the attached drawings, wherein.

DETAILED DESCRIPTION OF THE PREFERRED EMBODIMENTS

Figure 2A:
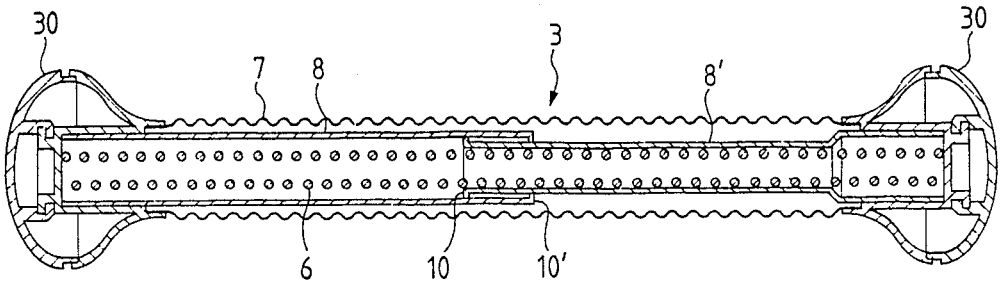
FIGS. 2A and 2B are, respectively, longitudinal sections through the apparatus according to FIG. 1 separated into its parts, i.e. broken down into two force or strength stages.
Figure 2B:
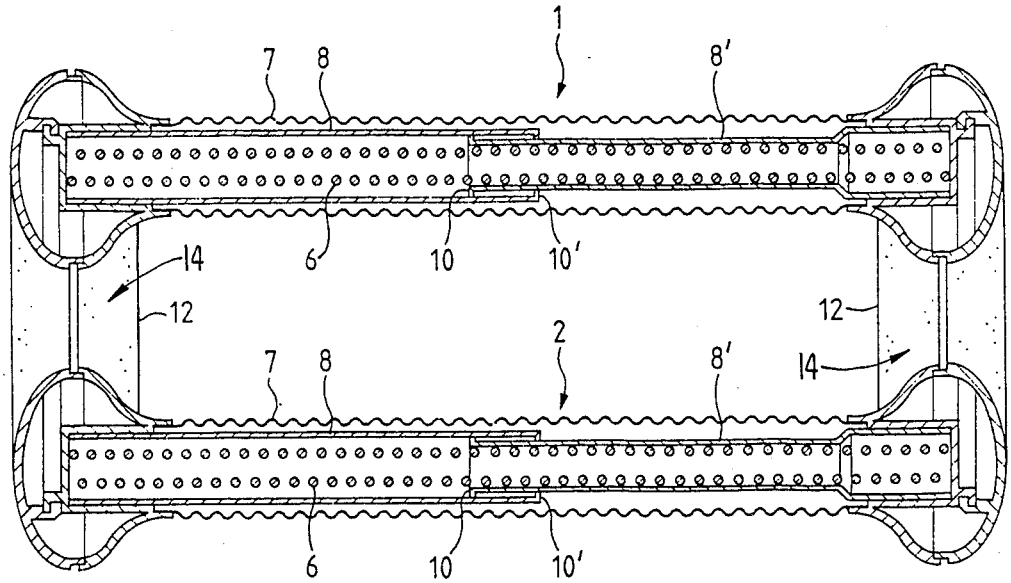
Figure 4:
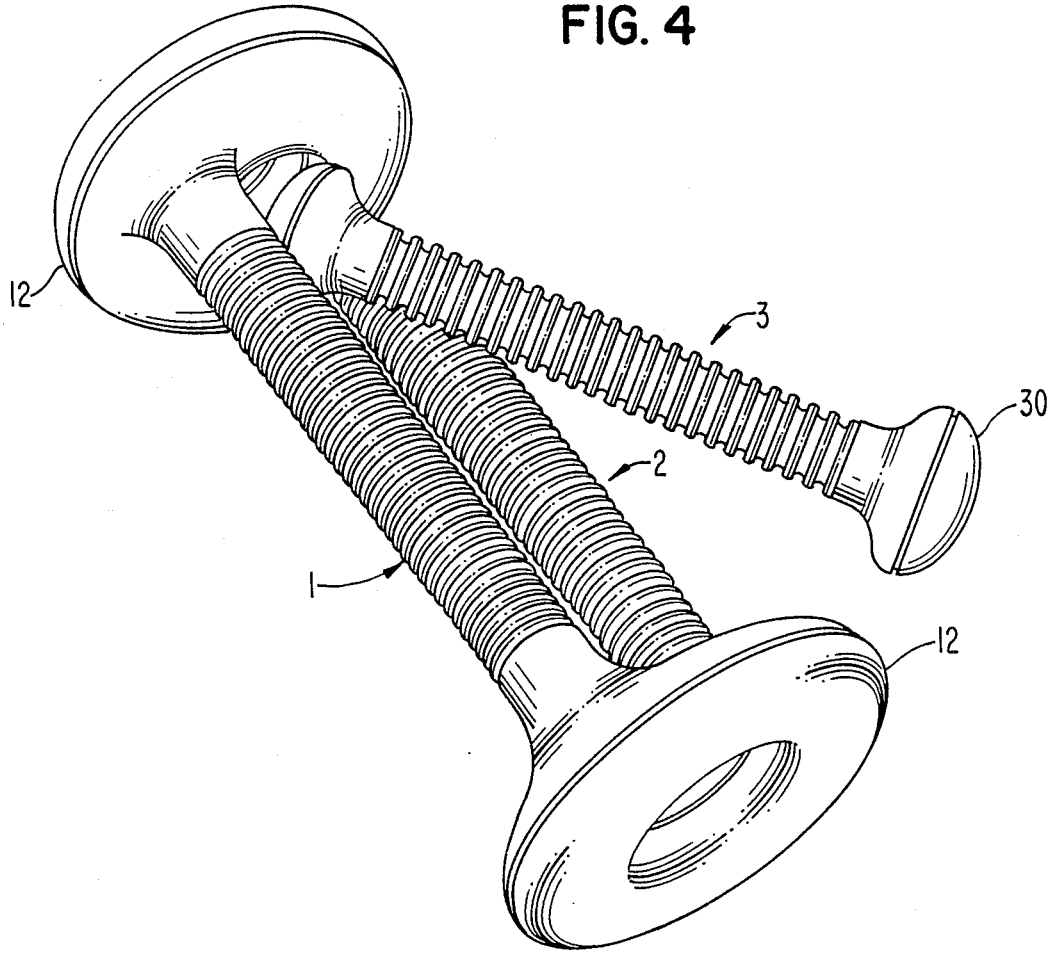
FIG. 4 is a perspective view of an apparatus according to FIGS. 1–3, partly assembled in the arrangement of FIG. 1.

The two apparatus parts shown in FIGS. 2A and 2B can, as a function of the particular constructional embodiment, be combined to a compression or tension spring apparatus. The length difference of the individual part with only one spring element compared with the individual part with two spring elements can already be provided in the construction or can be brought about by a pulling apart of the springs. Thus, the two apparatus parts can be individually used in one case and combined to two different apparatuses in the other. Thus, there is no need to give consideration to specific proportions. The central part can be constructed as a tension bar or as a compression bar if no spring pretension of the central part (individual bar) is desired or it can be used both as a compression bar and a tension bar if a spring pretension is desired or is at least accepted.

Thus, the apparatus permits three-stage training, both as regards tension (pulling) and pressure. Thus, there is a choice between six possibilities and it will be shown hereinafter that the changing of the force or strength stages can be realized in the manner defined hereinbefore, i.e. in a simple manner without any particular force expenditure.

Figure 1:
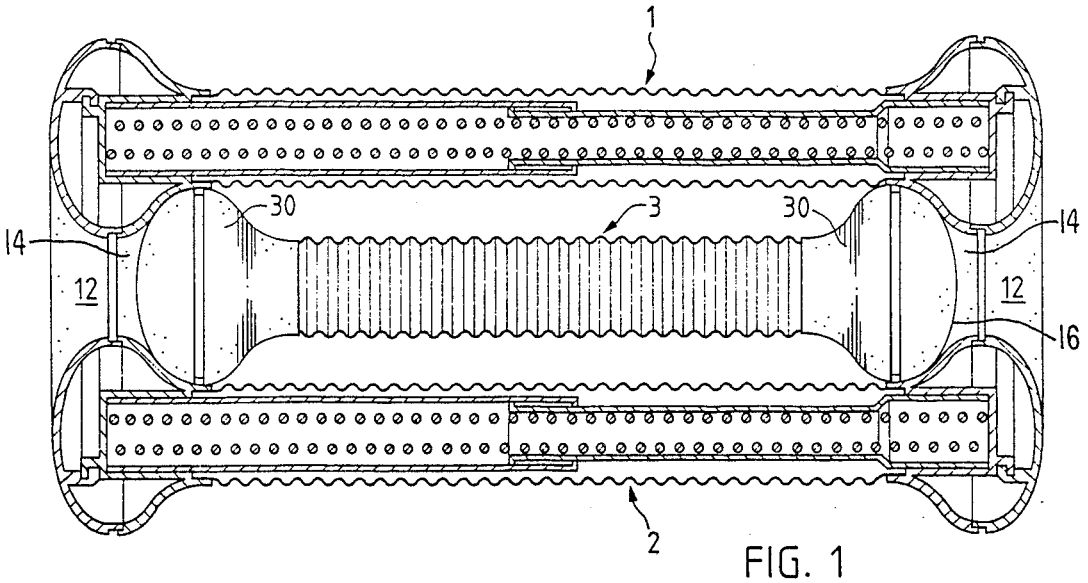
FIG. 1 is a longitudinal section through a compression spring apparatus with three compression spring bars.

FIG. 1 shows a construction which, as a compression spring apparatus, serves to strengthen the pectoral muscles (pectoralis major) as the primary objective, the shoulder girdle (deltoids and trapezoids) as a secondary objective, as well as being used for strengthening the pelvic muscles (iliacis) and additionally the inner leg muscles (rectum internum, sartorius, aductorius). For the upper body parts the apparatus is pressed together with both hands and for the lower body parts with both knees. For this use, the apparatus only used for pressing and not for pulling. It is expressly not designed for bending. This ensures that on the one hand muscle groups other than those aimed at are not subject to increased activity and on the other hand the apparatus is not used other than for the intended purpose.

For safety reasons, the spring displacements are very short, because it has proved that long spring displacements are not useful. This increases the operational reliability of the apparatus, because the potential energy which can be stored in the spring material is obtained from the product of the spring displacement multiplied by the spring constant. A spring displacement of ½ to 2 cm is completely adequate and also helps to simplify the construction. Obviously spring material does not solely relate to a metallic (tension or compression) spring and the spring material can also be of any other suitable elastic material allowing compression and/or pulling.

The apparatus comprises the following main parts. Spring elements 1, 2, 3 and gripping elements 12, 30, i.e. the grips of the spring elements 1 and 2 or the grips of spring element 30. The spring elements are here arranged in one plane. The gripping elements are substantially circular and have a gentle rounding. Gripping elements 12 are toroidal, such a toroid being very pleasant to grip and no special hand forces being required for holding the apparatus during activation. Gripping element and spring element together from the spring bodies 1, 2 or 3.

FIGS. 2A and 2B show the apparatus broken down into two force or strength stages, for which purposes two separable groups of spring bodies are individually shown. One spring body has two spring elements 1, 2 and the other spring body has one spring element 3. The force distribution can here be e.g. 2:1.

Spring bodies 1, 2 and 3 have the desired, rounded grips 12 and 30, which can be engaged in one another in the represented manner. Grips 12 are constructed as toroids and to the circumference thereof two spring elements are fixed, separated by angles of 180°. The spring element-side concave curvature 14 of each grip 12 is such that the trumpet-shaped, outwardly convex end 16 of curved grip 30 of spring body 3 can be snugly fitted into grip 12. The inner, concave curvature 14 of grip 12, which axially engages the trumpet-shaped end of grip 30, secures the inserted spring body 3 against radial sliding out when the apparatus is being used. As is clear, the change from one force or strength stage to the other can be brought about by simply removing the spring body group 3 from spring body group 12 without requiring any special force and without any special knowledge. By a gentle pressing in or out, one spring body can be separated from the other and individually used.

It is consequently possible not only to use the individual force stages but, as in this way two apparatuses are available, the training can be so combined that jointly the pelvic and pectoral muscles are subject to training, without casting doubts on the specific operation of the apparatus and its effect for action. Thus, both elements function in the same way, but at different force levels.

As can be gathered from the sectional drawings of FIGS. 2A and B, the spring bodies are constructed in known manner. The compression-stressed spring elements comprise a compression spring 6 arranged in a telescopic tube. The telescopic tube comprises two pipes 8, 8' inserted in one another, which are prevented from being drawn out and therefore from exposing the springs, e.g. by a simple turning lock with slot and dog (stop). FIGS. 2A and B show beading 10 and 10', which in the simplest possible manner prevent one telescopic tube from sliding out of the other. The circular gripping elements are arranged on the ends of both tubes. As stated, they are trumpet-shaped or annular (toroidal) parts, the trumpet-shaped part of one being insertable into the inner part of the other. The telescopic parts can be covered with a bellows 7.

The spring element, tube and spring is preferably covered with a bellows. As the spring displacement is short, i.e. as stated approximately ½ to 2 cm, the bellows is not exposed to higher mechanical stresses. To prevent damage to the apparatus in the case of unintentional bending, particularly that apparatus part having only one spring element, a tube wall thickness is chosen which is able to withstand such buckling loads. The tubes are preferably made from plastic. This permits the apparatus to be made with a relatively low weight, but still ensures adequate strength, whilst also ensuring that the apparatus has a low noise level (no squeaking noises). The compression spring is preferably of metal. However, it can also be a rod-like, elastic body with a sufficiently high elasticity value. The spring work is approximately 10 to 20 kp/cm. However, this is only a guidance value, which can be correspondingly extended upwards and downwards.

Figure 3:
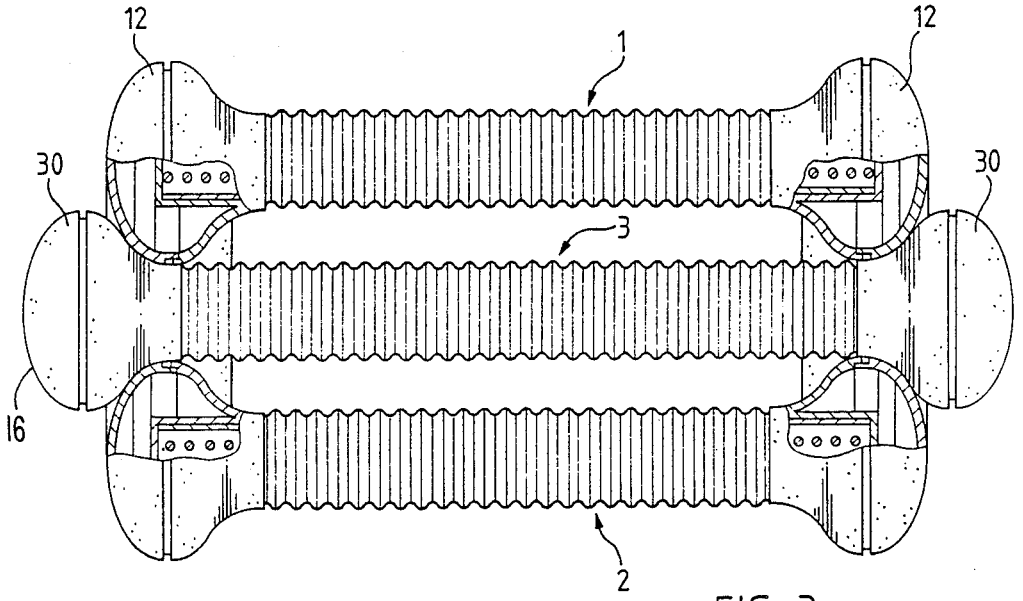
FIG. 3 is a side elevation of the apparatus according to FIG. 1 or 2 as a tension spring apparatus with three tension spring bars.

FIG. 3 shows the apparatus as used for pulling. It is expressly pointed out that the above-described apparatus only intended for compression or pressure-based exercises, can be a completely independent apparatus, not intended for a similar exercise form involving pulling. However, if it is wished to use the variant with the additional pulling possibility, then both gripping tori 12 must be circumferentially broken away, so as to permit the insertion of the bar-like spring element, as shown in FIG. 3. In order to be able to insert apparatus part 3 in apparatus part 1, 2 in an easy manner and without any particular force, it has proved possible to provide slots in the two gripping rings on the same side, as well as on opposite sides. Apparatus part 3 is e.g. secured between the index and middle finger, pulled apart somewhat and the apparatus part 1, 2 is gently pressed against it with the thumbs, so as to slide the bar-like spring part through the slots. If the apparatus is then released, the two parts 3 and 1, 2 are located within one another and can now be jointly drawn apart. Thus, coupling is as easy as in the apparatus for compression.

Preferably, in the case of an apparatus only designed for pulling or tension exercises, the middle spring body 3 is somewhat longer than the spring bodies 1. 2. As particular significance is attached to short spring displacements, by a "compensatory" lengthening it is possible to facilitate insertion in the toroids. In the case of a combined apparatus, i.e. one used for both pulling and compression exercises, the spring bodies have the same length, as is the case with an apparatus only intended for compression exercises. As there is a free choice regarding the spring tension, in a pulling exercise apparatus the middle spring body will be constructed in such a way that it can be easily inserted. There is no need to describe how in the pulling exercise apparatus the spring element has to be anchored in the gripping region in order to be able to absorb the pulling or tensile force.

The grips 12 and 30 of the apparatus are pleasantly rounded and are preferably made from a tough plastic. It is very cost-effective to use the same material for the telescopic tube and the fixed grip. Thus, a telescopic tube part with grip can comprise an injection moulded part, so that it is only necessary to insert and optionally anchor the spring or elastic part, place over the bellows and then insert and lock the other telescopic tube part in order to assemble the apparatus.

Obviously in other embodiments the apparatus can have interchangeable and/or insertable springs or elastic parts with different spring constants, which enable a different exercise program to be completed. This is appropriate if initially only a very reduced strength or force is used. During muscular recovery, it is possible to "strengthen" the apparatus, without having to buy a new apparatus.

We claim:

1. Training apparatus for the planned strengthening of individual muscle groups with at least one spring body and with in each case at least one gripping element thereon, characterized in that the gripping elements (30) of a first spring body (3) are terminally arranged on a spring element (6) and that terminal gripping elements (12) of a second spring body (1, 2) are so constructed with at least one further spring element (6, 6), that the gripping elements (30) of the first spring body can be inserted in the gripping elements (12) of the second spring body.

2. Training apparatus according to claim 1, characterized in that the gripping elements (30) of the first spring body have a concavely shaped part and/or a convexly shaped part and the gripping elements (12) of the second spring body are toroidal, the inner region of the toroidal gripping element having a concave depression in such a way that the convex part or the concave part of the gripping elements of the first spring body, introduced as desired from one or other side, fit into the concave depression in the inner region of the toroidal gripping elements.

3. Training apparatus according to claim 2, characterized in that on the toroidal gripping parts (12) of the first spring body (3) are arranged two spring elements (6, 6) and on the concave/convex gripping parts (30) of the second spring body (1, 2) a single spring element (6).

4. Training apparatus according to claim 3, characterized in that the two spring elements of the second spring body are arranged on the gripping part at an angle of approximately 180° and the spring element of the first spring body is arranged in the centre of the gripping part.

5. Training apparatus according to claim 4, characterized in that the toroidal gripping part (12) of the second spring body is not closed, so that the spring element of the first spring body can be placed in the centre of the toroid.

6. Training apparatus according to claim 5, characterized in that the first spring body is inserted with the convex portions of its gripping parts into the inner portions of the toroidal gripping parts of the second spring body.

7. Training apparatus according to claim 5, characterized in that the first spring body is inserted with the concave portions of its gripping parts in the inner portions of the toroidal gripping parts of the second spring body.

8. Training apparatus according to claim 7, characterized in that the spring element (6) of the spring body is an elastic body.

9. Training apparatus according to claim 7, characterized in that the spring element (6) of the spring body is a metal or plastic spring.

* * * * *